United States Patent [19]

Currell

[11] 4,201,608

[45] May 6, 1980

[54] METHODS OF AND APPARATUS FOR MANUFACTURING PILE FABRICS

[76] Inventor: Herbert H. Currell, "Hillcrest", 32, Lickhill Rd. North,, Stourport on Severn, Worcestershire, England

[21] Appl. No.: 895,530

[22] Filed: Apr. 11, 1978

[30] Foreign Application Priority Data

Apr. 15, 1977 [GB] United Kingdom ..... 15766/77

[51] Int. Cl.[2] ..... D04H 11/00; B32B 5/08

[52] U.S. Cl. ..... 156/72; 156/435

[58] Field of Search ..... 156/72, 135; 28/159; 26/2 R

[56] References Cited

U.S. PATENT DOCUMENTS 3,531,343 9/1970 Couquet ..... 156/72

3,878,011 4/1975 Currell ..... 156/72

FOREIGN PATENT DOCUMENTS 1077069 7/1967 United Kingdom .

1077070 7/1967 United Kingdom .

1230096 4/1971 United Kingdom .

*Primary Examiner*—Michael W. Ball

*Attorney, Agent, or Firm*—Neil F. Markva

[57] ABSTRACT

In the production of a pile fabric by the method described in U.S. Pat. No. 3,878,011 in which pile tufts are implanted in a layer of adhesive and the adhesive is subsequently heated to reduce the viscosity of the adhesive temporarily, the pile tufts are subjected to a tamping operation while the viscosity of the adhesive is reduced.

10 Claims, 2 Drawing Figures

METHODS OF AND APPARATUS FOR MANUFACTURING PILE FABRICS

BACKGROUND TO THE INVENTION

In U.S. Pat. No. 3,878,011, there is disclosed and claimed a method of producing a pile fabric comprising the steps of feeding a pre-formed base fabric with a layer of adhesive to a tuft-attaching station extending transversely of the direction of feed of the base fabric. The adhesive has a composition such that its viscosity decreases on heating and is in a sufficiently sticky condition at the attaching station to cause yarn pressed into the adhesive to adhere thereto. A row of tuft-forming lengths of pile yarn is brought to said station from a source presenting yarn ends in a row. A first part of each tuft-forming length is pressed into the layer of adhesive to attach said part to the base fabric, with a further part of each tuft-forming length projecting from the adhesive layer. The base fabric is fed with said row of tuft-forming lengths adhering thereto, away from the attaching station. Then the viscosity of said adhesive is temporarily reduced to secure the tuft-forming lengths to the base fabric by temporarily raising its temperature.

Also disclosed in said prior patent is an apparatus for the production of pile fabric comprising the combination of means for feeding a pre-formed base fabric and an adhesive along a feed path through a pile attaching station. First heater means supplied heat to the adhesive approaching said attaching station. Feeding means feeds a row of tuft-forming lengths of pile yarn from a source thereof to the attaching station and pressing means presses a part of each tuft-forming length into the adhesive at the attaching station. Second heater means supplies heat to the adhesive after passage through the attaching station. The second heat means is operative, during use of the apparatus, to raise the temperature of the adhesive temporarily.

The present invention is concerned with certain improvements in, or modifications of, the method claimed isn said prior patent and is further concerned with the provision of a new or improved form of apparatus for the performance of such improved or modified method.

Referring firstly to the method of making the pile fabric, a first aspect of the present invention relates to an additional operation which may be performed on the fabric to overcome or reduce unevenness of pile height and variability as to the strength of attachment of the pile tufts through the adhesive to the base fabric.

In practicing the method disclosed and claimed in said prior patent, the reduction of the viscosity of the adhesive by raising its temperature after part of each tuft-forming length of yarn has been pressed into the adhesive, that is to say implanted therein, may cause bubbles to be formed in the layer of adhesive. This causes certain of the implanted tufts to rise to varying degrees relative to the base fabric, with the result that the surface of the pile fabric becomes noticeably uneven. The formation of bubbles which disturb the adhesive layer can result from the presence of air or of volatile materials, for example water or oil, on or in the base fabric or in the adhesive layer. The base fabric is typically formed of hessian and this material tends to retain moisture until it is heated. The heating of the adhesive is usually affected by means of a hot metal plate which contacts the face of the base fabric remote from the adhesive layer. This plate makes it difficult for air and vapors to escape from the base fabric other than through the adhesive layer.

SUMMARY OF THE INVENTION

From a first aspect, the present invention resides in a method of producing a pile fabric comprising the steps of implanting tufts of pile yarn in a layer of adhesive carried on a base fabric and, after such implantation, temporarily reducing the viscosity of the adhesive by heating the adhesive, wherein outer ends of the tufts are subjected to a tamping operation while the viscosity of the adhesive in which the tufts are implanted is reduced.

The term "base fabric" as used herein is to be deemed to include any suitable form of sheet material whether woven or not. By the outer ends of the tufts is meant the ends which are remote from the layer of adhesive.

The tamping operation may be effected by supporting the base fabric at a tamping station on a backing surface engaging the face of the base fabric remote from the pile tufts and engaging the outer ends of the pile tufts by a tamping member having a tamping surface presented towards the tufts and movable towards and away therefrom. The limit of approach of the tamping surface to the backing surface is such that the clearance between these surfaces is just less than the overall depth of the fabric.

By "overall depth" is meant the depth of the fabric presented by the most deeply implanted tufts immediately prior to the tamping operation.

Ideally the tamping operation should be so conducted as to displace individual tufts towards the base fabric with only slight, if any, deflection of the legs of the tufts, and such that the parts of the tufts embedded in the adhesive should just touch the backing member on completion of the tamping operation.

In practice it is found satisfactory for the pile fabric to be fed continuously through the station at which tamping is performed. The time of contact between a tamping member performing the tamping operation and the outer ends of the pile is limited by so selecting the speed and mode of movement of the tamping member that there is little or no dragging effect. By "dragging effect" is meant angular displacement of the pile tufts relatively to the base fabric such as would cause these to lean over systematically in a trailing or leading attitude relative to the base fabric. A suitable mode of motion of the tamping member is simple harmonic motion, or approximately simple harmonic motion.

The extent of the interference between the member performing the tamping operation and the fabric may be of the order of 10% of the overall depth of the pile fabric.

While the width, i.e. dimension of the tamping surface measured longitudinally of the feed direction of the pile fabric, is not critical, it is preferred that the width should be such that the tamping member is able simultaneously to engage a substantial number of rows of pile tufts. A width of the order of 25 to 75 millimeters provides satisfactory results in practice.

The frequency of movement of the tamping member may be such, in relation to the speed of feed of the pile fabric, that each row of tufts is subjected to only one tamping operation or to a plurality of tamping operations before passing out of the field of operation of the tamping member.

In an alternative mode of operation there is no relative movement between the tamping member and the pile fabric during engagement between the tamping member and the pile. Here, the feed motion of the latter may be intermittent with stationary periods coinciding with engagement by the tamping member, or the latter may be moved orbitally so as to have a component of movement along the feed path corresponding to that which the engaged tufts undergo during tamping.

From a second aspect, the invention resides in the provision of apparatus for operating upon the pile tufts of a pile fabric in which the pile tufts are secured to a pre-formed base fabric by implantation in a layer of adhesive thereon from which the tufts project. Such apparatus comprises means defining a feed path for the fabric through a tamping station and heating means for supplying heat to the adhesive of the fabric at a position upstream of the tamping station for temporarily reducing the viscosity of the adhesive. Backing means at the tamping station supports the base fabric at the face thereof remote from the pile tufts. A tamping member is mounted for movement towards and away from the backing means for engaging the outer ends of the pile tufts to tamp same into the adhesive, and drive means moves the tamping member.

BRIEF DESCRIPTION OF THE DRAWINGS

The invention will now be described, by way of example, with reference to the accompanying drawings wherein.

DETAILED DESCRIPTION

In carrying out the method of the present invention, the pile fabric may be made by the method and by means of the apparatus disclosed and claimed in prior U.S. Pat. Nos. 3,847,691 and 3,878,011. Accordingly, the apparatus for and method of producing the pile fabric will be described herein only briefly.

Figure 2:
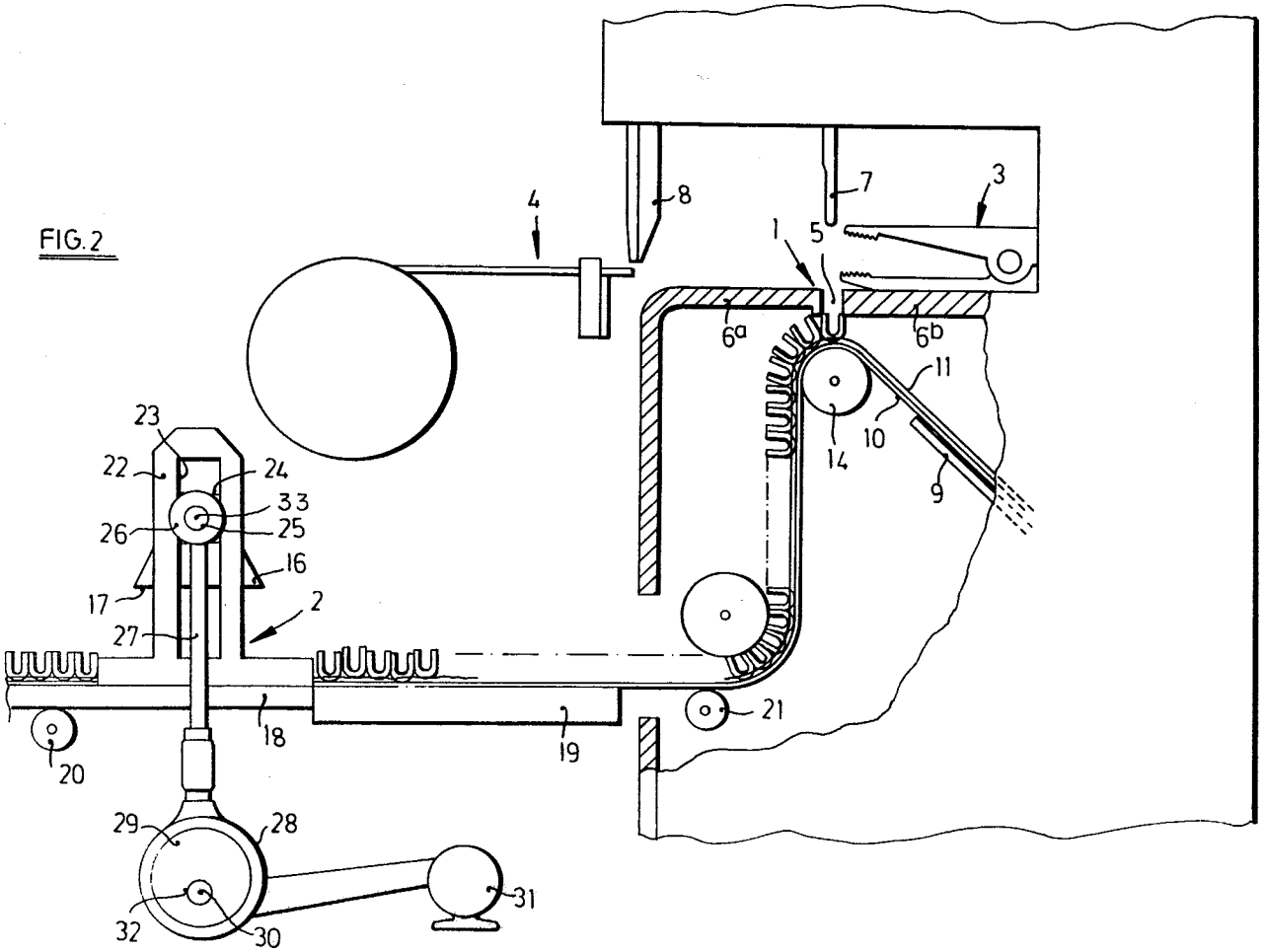
FIG. 2 shows diagrammatically a side elevation of one embodiment of apparatus for performing the method, certain parts of the apparatus being broken away.

The apparatus illustrated in FIG. 2 comprises guide means for guiding a base fabric 10 along a path which extends through an attaching station 1 and a tamping station 2. An adhesive layer 11 is carried on one face of base fabric 10, this face being presented upwardly at both the attaching station and the tamping station in the arrangement shown in FIG. 2. Grippers 3 draw tuft-forming lengths of yarn from a source 4 of pile forming yarn to attaching station 1 where each such length extends across a gap 5 between horizontal plates 6a and 6b. Gap 5 between these plates had a width which is less than the length of each piece of yarn and is situated directly above a roll 14 which supports base fabric 10 at the attaching station. A presser bar 7 presses a mid portion of each length of yarn through gap 5 into adhesive layer 11. Presser 7 is mounted for vertical reciprocation and as it descends into contact with the lengths of yarn, grippers 3 open to release the lengths.

The apparatus also includes a knife 8 for cutting the tuft-forming lengths of yarn from the yarn provided by the source 4.

A first heater 9 is provided at a position upstream of attaching station 1 for transmitting heat to adhesive layer 11 on base fabric 10 preparatory to implantation of the tufts of pile yarn at attaching station 1. The heater 9 is an electrically heated plate which is engaged by that face of base fabric 10 which is remote from adhesive layer 11. The adhesive is a hot melt adhesive. Its temperature is raised by heater 9 to a value such that, at the attaching station 1, the adhesive is in a tacky condition such that lengths of yarn which are pressed into adhesive layer 11 are adhered to base fabric 10. At attaching station 1, adhesive layer 11 is sufficiently soft to enable lengths of yarn to be implanted in the adhesive layer but the viscosity is not sufficiently low to enable the adhesive to penetrate completely through the thickness of each length of yarn. Since the first heater 9 is spaced downstream from attaching station 1, adhesive layer 11 will have begun to cool by the time it reaches attaching station 1. Such cooling continues as the base fabric 10 with the tufts adhered thereto is fed on from attaching station 1. Accordingly, the viscosity of the adhesive increases as the adhesive moves away from attaching station 1. Although the adhesive is not able to penetrate completely through each tuft-forming length of yarn, the adhesive does provide increasingly firm support for the tufts against displacement of the tufts relative to base fabric 10 from the required positions of the tufts.

A second heater 19 is situated between attaching station 1 and tamping station 2 at a position along the feed path of base fabric 10 through the apparatus. The second heater 19 is immediately adjacent to tamping station 2 and is spaced a considerable distance along the feed path from attaching station 1. Before the adhesive reaches second heater 19, it will have cooled to a temperature near to the ambient temperature and set to a flexible solid. The second heater 19 is an electrically heated plate which engages the face of base fabric 10 remote from adhesive layer 11. The second heater 19 raises the temperature of the adhesive and causes a temporary reduction in the viscosity of the adhesive to a value such that the adhesive can penetrate completely through the thickness of that portion 13 of each tuft which is implanted in adhesive layer 11. Preferably, the adhesive also permeates by capillary action to some extent up the projecting leg 15 of each tuft.

The guide means for base fabric 10 includes guide rolls 20 and 21 which can be moved between the position shown in FIG. 2, in which they guide base fabric 10 across the surface of the second heater 19, to second positions in which they guide base fabric 10 along a path spaced from the second heater 19. This arrangement enables the pile fabric to be moved out of contact with second heater 19 if travel of the pile fabric through the apparatus is interrupted.

With exception of the tamping station 2, the apparatus thus far described is generally the same as that described in our prior U.S. Pat. No. 3,878,011.

Figure 1:
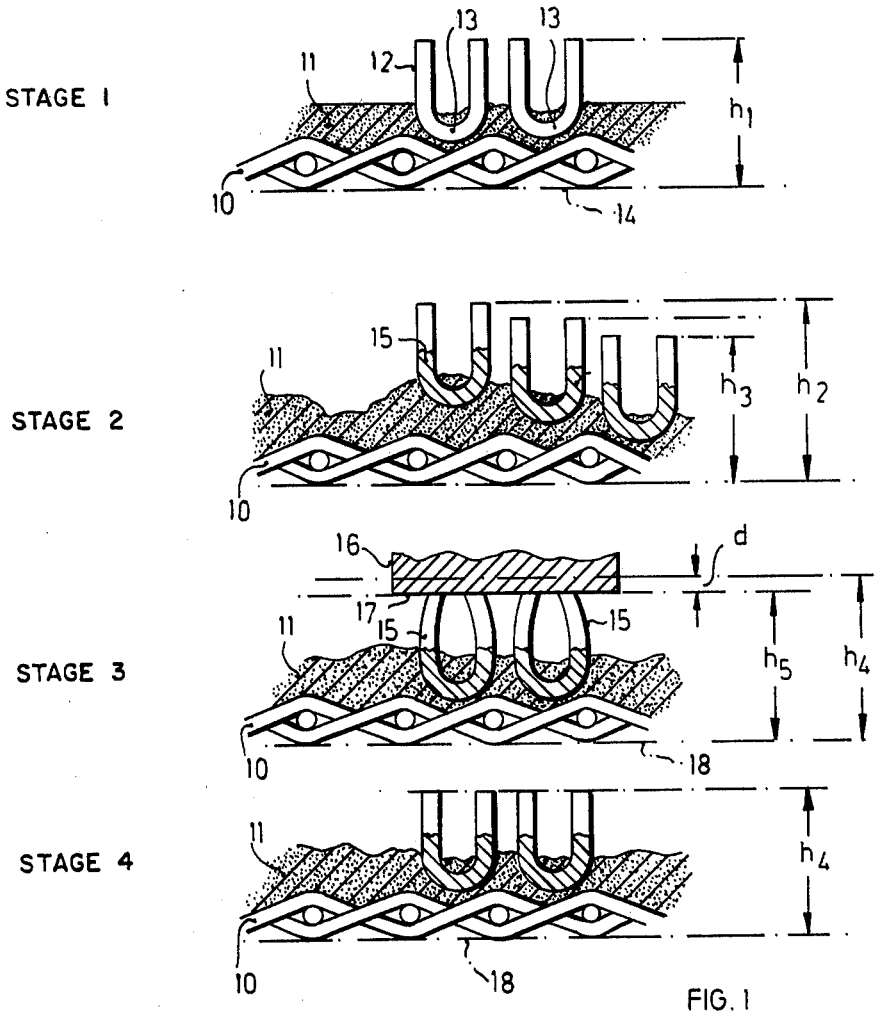
FIG. 1 illustrates diagrammatically performance of the method.

In FIG. 1, there are illustrated diagrammatically, and in a somewhat simplified manner, what takes place in successive stages of the method, stage 1 being the implanation of pile tufts 12 into adhesive layer 11 and stage 2 being the re-heating of the adhesive which occurs at the second heater 19.

In stage 1, the overall height of the pile fabric h1 is substantially uniform along its length. This occurs during implantation of tufts 12 when base fabric 10 rests upon supporting roll 14 at a predetermined height and presser 7 descends to a predetermined height above roll 14 while engaging the upper side of the base or connecting portion 13 of each U-shaped tuft 12.

In Stage 1, the temperature of the adhesive may be in the range 75° C. to 110° C. In stage 2 the temperature of the adhesive is raised to a value appreciably above the range, for example to a value of 170° C. At this higher temperature, the bubbling effects previously mentioned are noticeable and this results in certain tufts 12 being raised relative to base fabric 10 so that the pile height is increased to a value such as h2 which is greater than h1; whereas other tufts 12 may be lowered to a height h3 less than h1.

To restore uniformity of pile height, a tamping operation is performed in stage 3 as illustrated in FIG. 1. Stage 3 is performed at tamping station 2 where base fabric 10 is supported on a platform 18 arranged at the same level as and end-to-end with second heater 19. In this tamping operation, a tamping member 16 having a downwardly presented plane tamping surface 17 is moved towards the fabric to engage the outer ends of tufts 12 and approaches the level of supporting surface of the platform 18 to a minimum separation h5 which is perferably less than the lowest height h3 at which tufts 12 are found in stage 2 and is slightly less than the height h4 which is ultimately required to be presented by the fabric when finished.

During stage 3, depression of tufts 12 preferably takes place with only a slight bowing of legs 15 of tufts 12 as seen in FIG. 1 and the lower sides of their U-shaped base portions 13 are brought into contact, or nearly into contact with base fabric 10. The uneven thickness of adhesive layer 11 is not necessarily made uniform, although the thickness may become more uniform as a result of physical displacement of the raised tufts 12 in a downward direction which will tend to carry some of the higher parts of the adhesive in the downward direction with tufts 12.

In stage 4, cooling of the adhesive is allowed to take place naturally or is assisted by the impingement of a cooling fluid such as air on the adhesive, preferably from underside, and for this purpose the platform 18 may be of perforate form. Legs 15 of tufts 12 are freed from downward forces exerted by the tamping member 16 and regain a straight condition with their outer ends situated at the uniform height h4.

Preferably the degree of "interference", that is h4–h5, is of the order of 10% of h4.

The horizontal movement of base fabric 10 is preferably kept to a low value during the interval when tamping member 16 is traversing the distance d representing the difference between h4 and h5 so that any dragging effect is kept to a minimum. Such dragging effect may be eliminated altogether by arranging that base fabric 10 is fed intermittently and is stationary during travel of tamping member 16 through the distance d.

If base fabric 10 is fed continuously through tamping station 2, the speed may typically be of the order of 1 meter per minute and engagement between tamping member 16 and the outer ends of tufts 12 takes place over an interval during which the fabric advances 0.1 millimeter and the dragging effect of the tamping member on legs 15 of tufts 12 is negligible.

At tamping station 2, upstanding guide members 22 are provided at opposite lateral boundaries of the feed path for base fabric 10. Each guide member 22 includes a vertical guideway 23 along which a slide 24 is able to reciprocate vertically. The slides 24 are connected together by a tie member carrying tamping member 16. The outer ends of slides 24 terminate in trunions 25 which are embraced by bearings 26 at the upper ends of connecting rods 27 connected at their lower ends to eccentric sheaves 28 and eccentrics 30. The guide members 22 prevent movement of slides 24 about the axis 33 of their respective trunions 25 and so maintain the tamping surface 17 horizontal.

An electric motor 31 is connected by a belt and pulley drive to a shaft 32 carrying eccentric 29. The motor may be a variable speed motor. Alternatively, a varible ratio drive may be provided between motor 31 and shaft 32 so that the tamping frequency can be varied to suit the speed of feed of base fabric 10.

A typical speed of operation would be 100 rpm of the eccentrics 29 for a fabric speed of approximately 1 meter per minute and an interference distance d of the order of 1 millimeter.

Known feed means may be provided for advancing the fabric along the feed path. A spiked roller driven by a motor and situated at the downstream end of the feed path could be used.

It will be understood that the tamping device and the heater 19 could be used separately from the remainder of the apparatus. For example, the pile fabric could be wound into a roll after leaving the attaching station 1 and subsequently unwound from the roll to pass across the heater 19 and through the tamping station. Alternatively, pile fabric could pass over a second heater after leaving the attaching station and then be wound into a roll, subsequently being unwound and passed over a further heater into the tamping station.

I claim:

1. In a method of producing a pile fabric comprising the step of implanting tufts of pile yarn in a layer of adhesive at a first temperature while carried on a base fabric and the subsequent step of temporarily reducing the viscosity of the adhesive by heating the adhesive to a second temperature after such implantation, the improvement wherein outer ends of the tufts are subjected to a tamping operation while the viscosity of the adhesive in which the tufts are implanted is reduced during said subsequent step.

2. The improvement according to claim 1 further comprising an intermediate step of causing the viscosity of the adhesive to increase after implantation of the tufts and before said subsequent step.

3. The improvement according to claim 2 wherein the tamping operation is effected by supporting the base fabric at a tamping station on a backing surface engaging the face of the base fabric remote from the pile tufts and engaging the outer ends of the pile tufts by a tamping member having a tamping surface presented towards the tufts and movable towards and away therefrom, the limit of approach of the tamping surface to the backing surface being such that the clearance between these surfaces is just less than the overall depth of the fabric.

4. The improvement according to claim 3 wherein the extent of the interference between the tamping member and the pile fabric is approximately 10% of the overall depth of the fabric.

5. The improvement according to claim 2 wherein the pile fabric is fed continuously through the station at which tamping is performed and the duration of contact between a tamping member performing the tamping operation and the outer ends of the pile tufts is limited by so selecting the speed and mode of movement of the tamping member that there is no significant dragging effect.

6. A method of producing a pile fabric comprising the steps of:

(a) implanting tufts of pile yarn in a layer of tacky adhesive carried on a base fabric, then (b) heating the adhesive to temporarily reduce the viscosity of the adhesive causing the adhesive to permeate a portion of the yarn in said tufts which tend to rise from their implanted position while said adhesive is at a reduced viscosity, (c) tamping the outer ends of the tufts while the viscosity of the adhesive is reduced.

7. The method as defined in claim 6 wherein the pile fabric is fed continuously along a path during the tamping step, the tamping operation being effected so that there is no significant dragging effect while the pile fabric is continuously moving.

8. Apparatus for forming pile fabric, comprising:

(a) means for implanting pile tufts in a tacky adhesive layer on a pre-formed base fabric at an attaching station and downstream of said means for implanting pile tufts while the adhesive is at a first temperature, (b) means for moving the base fabric with the tufts projecting thereon along a path to a tamping station, (c) means for heating the adhesive of the fabric to a second temperature at a position upstream of the tamping station for temporarily reducing the viscosity of the adhesive which permeates said yarn, (d) backing means located at the tamping station for supporting the base fabric at the face thereof remote from the pile tufts, (e) a tamping member mounted for movement toward and away from the backing means and effective to engage the outer ends of the pile tufts to tamp same into the adhesive, and (f) drive means for moving the tamping member.

9. The apparatus as defined in claim 8 wherein the tamping member has a tamping surface presented toward the tufts, and the limit of approach of the tamping surface to the backing means being such that the clearance between these surfaces is just less than the overall depth of the fabric.

10. The apparatus as defined in claim 9 wherein the extent of the interference between the tamping member and the pile fabric is approximately 10% of the overall depth of the fabric.

* * * * *